United States Patent [19]

Joachim

[11] 4,437,766

[45] Mar. 20, 1984

[54] MIXER HAVING TWO FEED WORMS DEFINING UPPER AND LOWER MIXING REGIONS WITH AN INTERMEDIATE EQUILIBRIUM ZONE

[75] Inventor: Rudolph Joachim, Weil der Stadt, Fed. Rep. of Germany

[73] Assignee: Werner & Pfleiderer, Stuttgart, Fed. Rep. of Germany

[21] Appl. No.: 358,216

[22] Filed: Mar. 15, 1982

[30] Foreign Application Priority Data

Mar. 18, 1981 [DE] Fed. Rep. of Germany ..... 3110437

[51] Int. Cl.[3] ..... B01F 7/30

[52] U.S. Cl. ..... 366/287; 366/292

[58] Field of Search ..... 366/66, 83, 84, 88, 366/241, 261, 268, 287, 292, 288, 297, 298, 299, 300, 319, 322, 323

[56] References Cited

U.S. PATENT DOCUMENTS

| | | | |
|---|---|---|---|
| 1,733,516 | 10/1929 | Rodin et al. | 366/300 |
| 3,315,947 | 4/1967 | Nauta | 366/287 |
| 3,602,486 | 8/1971 | Nauta | 366/292 |
| 3,734,472 | 5/1973 | Strohmeier | 366/83 |
| 3,746,267 | 7/1973 | Myers et al. | 366/299 |
| 3,899,159 | 8/1975 | Nauta | 366/297 |

FOREIGN PATENT DOCUMENTS

| | | | |
|---|---|---|---|
| 1116195 | 11/1961 | Fed. Rep. of Germany . | |
| 2247518 | 4/1975 | Fed. Rep. of Germany . | |
| 904758 | 6/1980 | U.S.S.R. | 366/287 |

*Primary Examiner*—Philip R. Coe
*Assistant Examiner*—Michael Knick
*Attorney, Agent, or Firm*—Hane, Roberts, Spiecens & Cohen

[57] ABSTRACT

A mixer comprising a conical mixing vat, tapering downward toward a material egress, and a motor-driven mixing worm which rotates on its axis and revolves within the mixing vat, the mixing worm having an upper region with a small screw pitch and, a lower region with a large pitch and a neutral conveyance zone between the upper and lower regions. In order to achieve a stable pattern of the junction formed by the neutral conveyance zone of the mixing worm between the upper and lower regions, which will be independent of the degree to which the mixer is filled, a mixing worm rotates around another mixing worm which is placed centrally in the upper region of the mixing vat along its longitudinal axis, this worm being of cylindrical shape along its length and extending into the conveyance neutral zone and with its exterior diameter nearly touching the other mixing worm.

7 Claims, 3 Drawing Figures

MIXER HAVING TWO FEED WORMS DEFINING UPPER AND LOWER MIXING REGIONS WITH AN INTERMEDIATE EQUILIBRIUM ZONE

BACKGROUND OF THE INVENTION

The invention relates to a mixer with a conical mixing vat tapering downward toward an outlet and a motor driven mixing worm therein. A mixer of this type is shown in West German PS 2,247,518.

The principle of the known mixer resides in the fact that the mixture components are, in separate mixing ranges, first subject to a coarse mixing and then fed toward a more intensive mixing. The material for mixing, which is fed into the mixer discontinuously, is not directly deposited in the lower mixing range, but only after a phase of preliminary mixing, by which a good mixing result required for a continuous mixture discharge is attained. The separation of the two mixing ranges is achieved by the creation of a conveyance-neutral zone between the conveyance ranges of mixing worms rotating within the mixer housing.

In the outer field of the region affected by the mixing worm's conveyance-neutral zone, the material to be mixed is compressed due to the flow conditions resulting from its various pitches, while in the neighboring range an equilibrium region is created in which an easy passage of one portion of the material to be mixed takes place into the lower mixer range for the purpose of intensive mixing and discharge.

The compression of the materials to be mixed, particularly with the treatment of discontinuously fed mixture components, can have an adverse effect upon those individual mixture components which have a tendency to form agglomerates. Among these could be cited certain organic pigments intended for the coloring of the mixture material.

In certain operational phases, such as at the end of a mixing program, the mixer is only partially filled. Such a partial filling can result in the separation plane of the two mixing regions running diagonally to the mixer axis. The compression zone slopes off so sharply to the equilibrium zone that an adequate separation of the mixing regions is no longer assured.

BRIEF SUMMARY OF THE INVENTION

An object of the invention is to provide improvements in the conventional mixer such that its efficient application can also be achieved with such mixture components which have a tendency to compact easily.

Another object of the invention is to provide a mixer in which a stable course of the separation plane formed by the conveyance-neutral zone of the mixer worm between the upper and lower region is achieved, assuring in these mixing regions a separate mixing even of mixture materials with a tendency to the formation of agglomerates.

From West German publication OS 2 007 309 (and corresponding U.S. Pat. No. 3,602,486) a conical mixer with two stirrer elements is known, whereby the worm which rotates around the wall of the vat has a uniform, noninterrupted pitch and the second stirrer element is similarly arranged to rotate around the mixer axis. This known mixer is thereby of a different design with a stable mixture flow, whereby the second stirrer element merely serves to loosen the mixture material, with the result that an unequal time for the processing of introduced mixture components is not prevented. A continuous discharge of adequately mixed material is not possible even when the mixer vat is only partially filled.

The mixer according to the present invention prevents a premature sinking of the mixture components into the lower mixing region even when the mixing vat is only partially filled. The positioning of the central mixing worm along the longitudinal axis of the mixing vat and its extension into the conveyance-neutral zone makes possible a stabilization of the separation formed by this zone diagonal to the longitudinal axis of the mixer between the upper and lower mixing regions. In addition to this, there follows a reduction of the material compaction in this zone within the range of the rotating mixing worm, so that introduced materials which have a tendency to form agglomerates can be optimally homogenized.

The central mixing worm can be connected to the drive shaft of the main drive for the rotating mixing worm, eliminating the need for a separate drive mechanism.

Corresponding to another embodiment of the mixer, an optimal filling capacity of the vat is possible.

In another embodiment of the mixer, an increase of the mixing efficiency in the lower region of the mixer is attained with a consequent reduction of the time required for mixing. In addition, a homogeneous mixture material yield is assured from both mixing regions.

In line with a configuration for the attainment of this effect, an increased energy input into the material to be mixed is made possible, so that an efficient treatment is attained even with discontinuously introduced supplemental materials.

BRIEF DESCRIPTION OF THE DRAWING

Other objects, features and advantages of the invention will be apparent from the following detailed description when read with the accompanying drawing which shows the presently preferred embodiments of the invention. In the drawing.

DETAILED DESCRIPTION OF THE PREFERRED EMBODIMENTS

Figure 1:
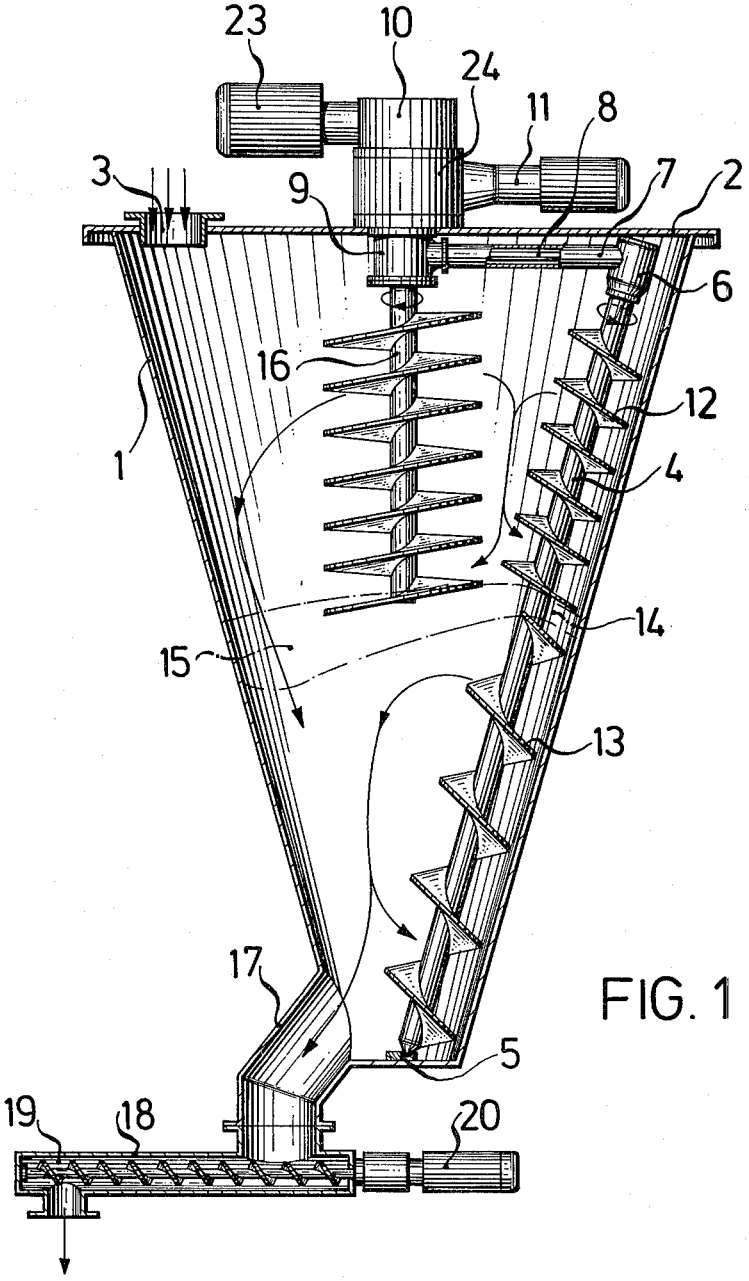
FIG. 1 shows a so-called conical worm mixer in longitudinal cross-section schematically with a central mixing worm extending into the conveyance neutral zone.

The conical worm mixer has a downwardly tapering conical mixing vat 1 with a lid 2 in which there is an opening 3 for the discontinuous introduction of the individual components for mixing. A mixing worm 4 is arranged in the mixing vat 1, the worm being pivoted in a bearing 5 at the bottom of the mixing vat and in bevel gearing 6. The bevel gearing 6 is borne by a rotating arm 7, whose internal shaft for torque transmission to the mixing worm 4 via a bevel gear 9 is powered by the drive motor 23 as is the worm drive 10. In addition to its rotation on its own axis, the mixing worm 4 is put into a rotating motion around a vat wall by means of the drive motor 11 and a worm gearing 24 above the rotary head of the bevel gearing 9 and the rotating arm 7.

The upper region of the mixing worm 4 is designed with a smaller pitch 12 and its lower region with a larger pitch 13. Between the two ranges there is a conveyance-neutral zone 14 within which no material at all is moved. Because of the differentiated conveyance performances of the mixing worm 4, the material to be mixed compresses in the conveyance-neutral zone 14, which, as indicated by the dotted line, extends as an equilibrium zone 15 across the entire vat diameter.

Along the central axis of the mixing vat 1 another mixing worm 16 is positioned, which extends approximately to the middle of the equilibrium zone 15 whose pitch is of the same magnitude as the pitch of the opposed mixing worm 4.

The rotation drive of the mixing worm 16 takes place in the same way as that of the mixing worm 14 by means of the drive motor 23 and the worm gearing 10, whose power take-off shaft is directly connected to the mixing worm 16.

The mixing worm 16 prevents a sinking of the upper preliminary mixing region of the conical worm mixer through the equilibrium zone 15, especially during partial filling of the vat. In addition, it diminishes the compression of the material to be mixed in the conveyance-neutral zone 14 by its upwardly directed conveyance effect.

The lower, fine mixing region which is demarcated at its top by the equilibrium zone 15, contains a basically constant mixing volume independent of the degree to which the conical worm mixer is filled. The discharge of the mixed material from the mixing vat 1 takes place via a discharge nozzle 17 which is connected to the housing of a discharge worm 19. The discharge worm 19 is operated by an infinitely variable motor, so that a dosing of the mixed material into an extruder (not shown) can take place for further processing.

Figure 2:
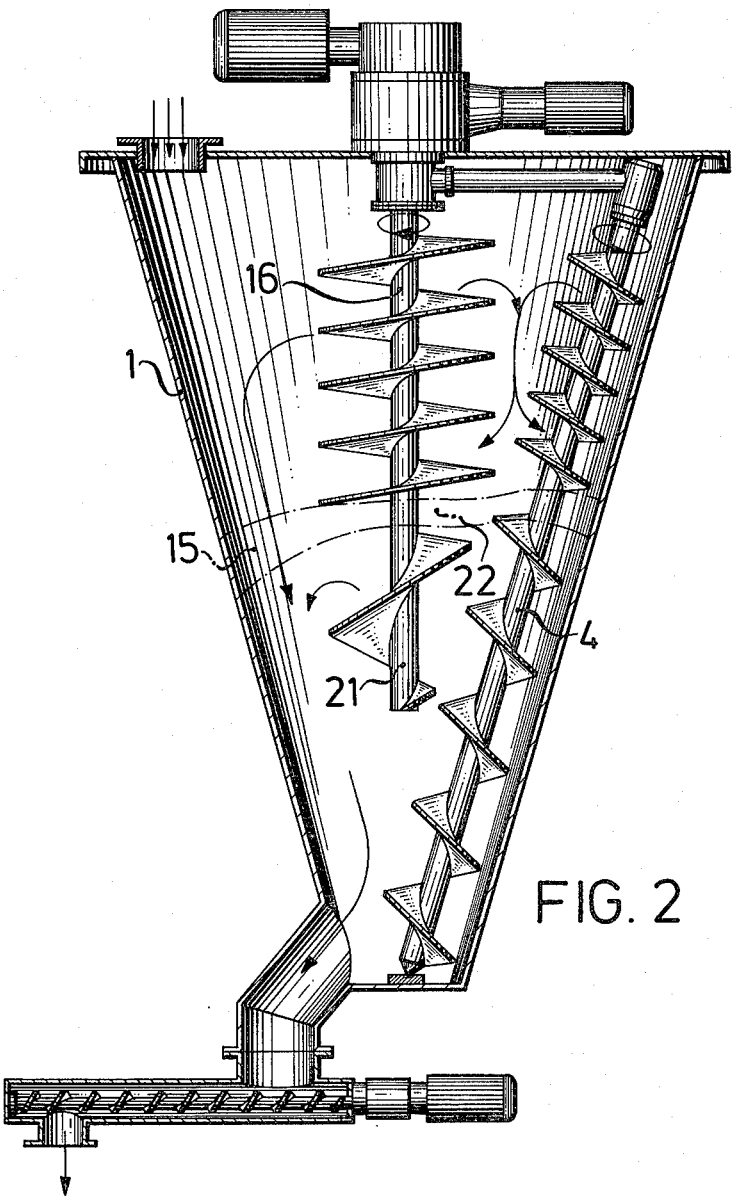
FIG. 2 shows an embodiment wherein the conical worm mixer of FIG. 1 has an additional mixing worm in the fine mixing range.

For increased mixing efficiency in the fine mixing region, the mixing worm 16 is, as shown in FIG. 2, combined with an additional mixing worm 21. To maintain the equilibrium zone 15, a conveyance neutral-zone is similarly maintained between the two mixing worms 16 and 21.

The mixing worm 21, in its exterior diameter, like the vat 1, tapers downward and, while maintaining its required freedom of play, touches i.e. tangentially contacts the mixing worm 4. By this means the material to be mixed is subjected to an intensified rotation, so that an optimal mixing effect is attained with a reduced mixing time.

The conveyance capacity of the mixing worm 21 which, with a constantly downwardly tapering worm diameter, is the result of the variables—pitch and worm rotational velocity—equals the conveyance capacity of the mixing worm 16 so that with an upwardly directed conveyance effect in the conveyance-neutral space 22 no compaction of the material to be mixed takes place. As a result, an easy transition of the material from the upper mixing region to the lower takes place.

Figure 3:
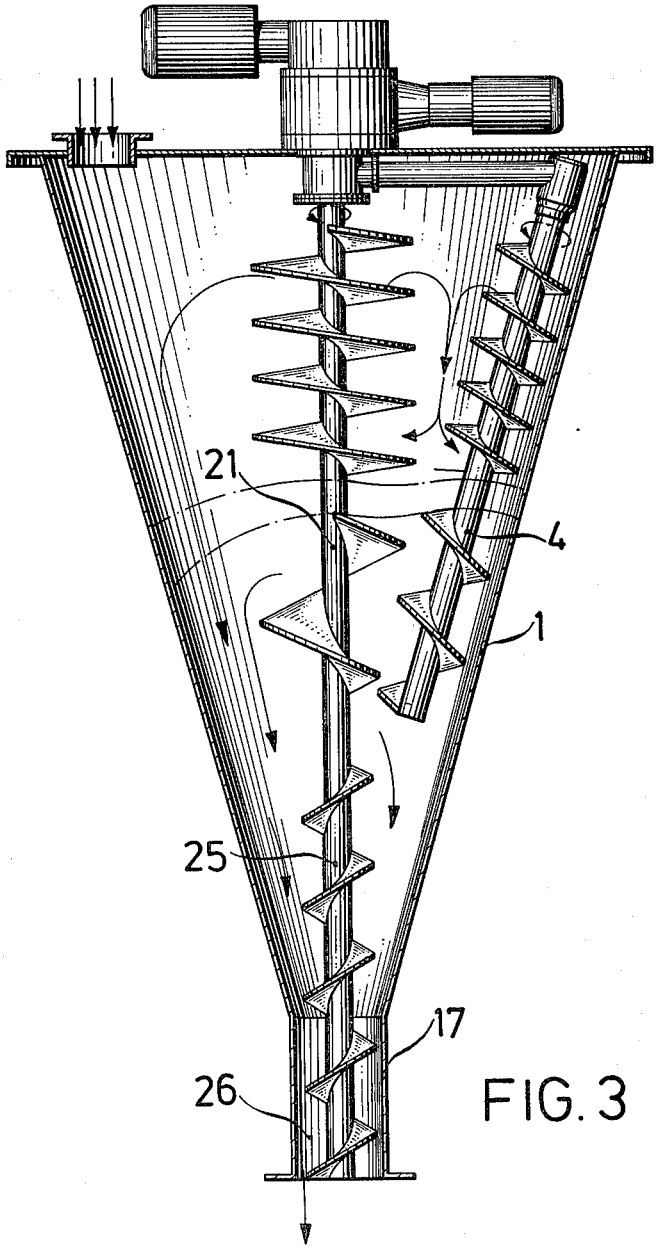
FIG. 3 shows another embodiment with an additional configuration of the conical worm mixer.

With finely granulated material to be mixed which tends to bowing, the mixing worm 21, as shown in FIG. 3, can be supplemented by a cylindrical tamping worm 25 or, as such, can be led into the discharge opening 26 to serve there as a tamping worm. In this case the discharge nozzle 17 must be placed concentrically to the longitudinal axis of the vat 1 and the mixing worm 4 arranged to one side, i.e., offset.

What is claimed is:

1. A mixer comprising a conical mixing vat having a wall tapering downwardly and having a discharge outlet near the lower end thereof, means for introducing material to be mixed into said vat at the top thereof, a first mixing worm driven in rotation about its axis and in revolving movement within said vat proximate said wall, said first mixing worm having an upper region of relatively small pitch and a lower region of relatively large pitch and defining between said upper and lower regions a neutral conveyance zone, and a second mixing worm driven in rotation about its axis, said second mixing worm being centrally disposed in said vat with the axis of the second mixing worm concentric with the axis of said vat, said second mixing worm extending downwardly from the top of the mixing vat up to and into said neutral conveyance zone, said second mixing worm being cylindrical and having an outer diameter in close proximity with the outer diameter of said first worm, said first and second mixing worms being driven in respective directions of rotation to each convey the material in the vat.

2. A mixer as claimed in claim 1 wherein said second mixing worm has a conveyance capacity equal to that of said upper region of said first mixing worm.

3. A mixer as claimed in claim 1 comprising a further mixing worm extending axially from said second mixing worm, said further mixing worm having a conveyance capacity equal to that of said second mixing worm.

4. A mixer as claimed in claim 1 comprising a drive motor, a power takeoff means connected to said drive motor and means for connecting said first and second worms to said power takeoff means.

5. A mixer as claimed in claim 1 wherein said upper and lower regions of said first mixing means have equal outer diameters.

6. A mixer as claimed in claim 1 wherein said upper and lower regions of said first mixing means respectively have uniform outer diameters.

7. A mixer as claimed in claim 1 wherein said second mixing worm has a lower end which terminates in said neutral conveyance zone.

* * * * *